US007594642B2

(12) United States Patent
Curchod

(10) Patent No.: US 7,594,642 B2
(45) Date of Patent: Sep. 29, 2009

(54) HIGH LOAD CONNECTION SYSTEM

(76) Inventor: Donald Butler Curchod, 32 Cabarita Road, Avalon, New South Wales (AU) 2107

( * ) Notice: Subject to any disclaimer, the term of this patent is extended or adjusted under 35 U.S.C. 154(b) by 100 days.

(21) Appl. No.: 11/917,061

(22) PCT Filed: Jun. 9, 2006

(86) PCT No.: PCT/AU2006/000790

§ 371 (c)(1),
(2), (4) Date: Dec. 10, 2007

(87) PCT Pub. No.: WO2006/130917

PCT Pub. Date: Dec. 14, 2006

(65) Prior Publication Data

US 2008/0197331 A1 Aug. 21, 2008

(30) Foreign Application Priority Data

Jun. 9, 2005 (AU) ..... 2005902989

(51) Int. Cl.
*B66D 3/04* (2006.01)

(52) U.S. Cl. ..... 254/390; 254/409; 254/902; 403/268

(58) Field of Classification Search ..... 254/902, 254/390, 409, 412, 416; 403/268, 269
See application file for complete search history.

(56) References Cited

U.S. PATENT DOCUMENTS

| | | | | | |
|---|---|---|---|---|---|
| 230,994 | A * | 8/1880 | Bitting | 384/276 |
| 360,050 | A * | 3/1887 | Redmond | 254/412 |
| 1,406,560 | A * | 2/1922 | Houghton | 254/406 |
| 3,672,712 | A * | 6/1972 | Davis | 403/268 |
| 6,305,669 | B1 * | 10/2001 | Harken et al. | 254/412 |
| 6,886,484 | B2 * | 5/2005 | Thomas | 114/108 |
| 2004/0154516 | A1 * | 8/2004 | Thomas | 114/102.1 |
| 2004/0156672 | A1 * | 8/2004 | Thomas | 403/266 |

* cited by examiner

*Primary Examiner*—Emmanuel M Marcelo
(74) *Attorney, Agent, or Firm*—Galbreath Law Offices, P.C.; John A. Galbreath

(57) ABSTRACT

A rigid high load lightweight block (1) has unidirectional high strength moulded fibre bundles (4*a*, 4*b*) in the side plates (3*a*, 3*b*) for the carrying of the major operating tensile loads within the block (1), thereby minimising the weight and maximising the load of the assembly.

18 Claims, 8 Drawing Sheets

HIGH LOAD CONNECTION SYSTEM

FIELD OF INVENTION

This invention relates to simple lightweight construction methods for connections of high tensile loads utilizing molded parallel fiber bundles which can be applied to numerous applications, including sail boat stays, shrouds and blocks etc.

BACKGROUND

Historically, these high loads and their connections have been taken by metal stays, shrouds and blocks. These have all been have been constructed using meta including stainless steel, resulting in relatively high weight and in stays, metal tapered compression cones.

Recently more advanced designs have replaced some metal with high strength braid, such as Spectra, Dyneema, PBO and carbon fiber etc. with a resultant reduction in weight, Since in a yacht, reduction in weight can be directly translated into improved performance, there exists a need to further reduce weight in high load yacht fittings, such as stays, blocks and shrouds.

Practability and termination of these newer systems however make them difficult to commercialize.

Lightweight blocks using braid connections are limited in some applications, where a more rigid construction is more appropriate.

SUMMARY OF THE INVENTION

The present invention relates to a design utilizing molded unidirectional high strength fiber bundles and their termination to take the major tensile loads with a subsequent reduction in metal mass to produce stays, shrouds and blocks with reduced weight and hence increased performance under high loads compared to the current state of the art.

An object of an embodiment of the invention is to provide a rigid high load lightweight block with a reduced mass employing unidirectional high strength molded fiber bundles in the side plates for the carrying of the major operating tensile loads within the block, thereby minimizing the weight and maximizing the load of the assembly. These high strength fiber bundles, such as carbon microfibers, are molded using plastic resin such as epoxy to form a rigid structure. This new technique or invention provides less metal in the block and increases the strength to weight ratio compared to current designs.

Another object of an embodiment of the invention is to provide a rigid high load lightweight block with a reduced mass employing unidirectional high strength molded fiber bundles for the primary load carrying major operating tensile loads within the block thereby reducing the weight of the assembly, and where the unidirectional molded fiber bundles are terminated and secured to the boat without the use of metal fasteners reducing the amount of metal in the block compared to current designs.

Another object of an embodiment of the invention is to provide a rigid high load lightweight block with a reduced mass employing unidirectional high strength molded fiber bundles in the side plates for the carrying of the major operating tensile loads within the block coupled with lightweight non metallic compression members separating the said fiber bundles, thereby reducing the weight of the assembly. This new technique or invention provides less metal in the block and increased strength lightweight rigid construction compared to current designs.

Another object of an embodiment of the invention is to provide a rigid high load lightweight block with a reduced mass employing unidirectional high strength molded fiber bundles in the side plates for the carrying of the major operating tensile loads within the block.

These tensile fiber bundles being encased within a relatively low strength molded plastic housing.

This new technique or invention provides less metal in a high load lightweight rigid block construction compared to current designs.

Another object of an embodiment of the invention is to provide a system for tensile connection with a reduced mass employing unidirectional high strength molded fiber bundles for the carrying of the tensile loads, such as shrouds and stays, terminated by rigid unidirectional high strength molded fiber bundle end pieces glued thereto.

Another object of an embodiment of the invention is to provide a system for tensile connection with a reduced mass employing unidirectional high strength molded fiber bundles for the carrying of the tensile loads, such as shrouds and stays, terminated by rigid unidirectional high strength molded fiber bundle end pieces connected thereto, where the central portion of the fiber bundles is not molded and hence remains flexible or is molded with a flexible plastic.

In one broad form the invention provides a rigid block having at least one sheave mounted between opposed side plates for rotation about at least one corresponding axis, said block including at least one substantially rigid unidirectional fiber bundle engaging or integrated into at least one of the side plates whereby a tension load applied to said at least one sheave is transferred via the at least one the side plate to the at least one fiber bundle.

The at least one fiber bundle is may be formed separately separate from the at least one side plate and attached thereto.

The at least one fiber bundle may be integrated into at least one side plate. This may be by encasing the fiber bundle with material that is also used to form the side plate.

At least part of the at least one fiber bundle may be molded.

The or each at least one fiber bundle may engage two or more side plates.

The or each fiber bundle may be comprised of a plurality of fiber strands. At least some of the plurality of fiber strands may be laid end on end and the ends of the fiber strands may overlap.

The or each fiber bundle may be formed of a single fiber strand.

The or each at least one fiber bundle may form at least one continuous loop and in embodiments form at least two continuous loops. The at least one fiber bundle may have ends, i.e. the fiber bundle does not form a continuous loop.

The block may include a first sheave mounted between a first pair of side plates, for rotation about a first axis, and a second sheave mounted between a second pair of side plates, for rotation about a second axis, said second axis spaced from the first axis, with at least one fiber bundle engaging or integrated into first and second side plates.

The first and second axes may be parallel and transversely spaced from each other. Alternatively, the first and second axes may be orthogonal to each other.

The or each fiber bundle may form a continuous loop and engages or be integrated into at least one first and at least one second side plates.

The block may have a fiber bundle forming a continuous loop that engages or is integrated into both first and both second side plates.

The block may include at least one spacer that engages spaced apart portions of at least one fiber bundle. The spacer may engage spaced apart portions of at least one fiber bundle located on the same side of a sheave. The spacer may engage spaced apart portions of at least one fiber bundle located on opposite sides of a sheave.

Preferably the at least one fiber bundle passes around the corresponding axis.

Preferably application of tension load to the sheave and the at least one fiber bundle places the or each side plate engaged by the at least one fiber bundle in compression.

Preferably the at least one side plate is non-metallic.

The at least one fiber bundle may have ends adapted to be secured in or to the structure of a boat.

The invention also provides the combination of a boat and the block as described above.

The boat may be provided with a wall and the ends of the at least one fiber bundle extend into respective recesses in the wall and are secured thereto. The recesses may include bores extending through the wall. The ends of the at least one fiber bundle may extend from a first side of the wall to the other side and are secured to the other side of the wall. The ends of the at least one fiber bundle may be received in hollow plugs received in the bores. At least one of the plugs may include a connector for connection of a tension member, to transfer load from the respective fiber bundle via the plug and the tension member to another part of the boat.

The invention also provides an elongate tension member comprising at least one bundle of unidirectional fibers the elongate tension member having connectors at each end thereof. The connectors may be glued or bonded to the ends of the at least one bundle of fibers.

The connectors may be formed of fibers encased in a resin. The ends of the at least one bundle of fibers may be received in recesses in the connectors. The end portions of the at least one bundle of fibers may be substantially rigid.

At least an intermediate portion of the at least one bundle of fibers between the end portions may be flexible. The intermediate portion may be substantially comprised of fibers without resin. The intermediate portion may be comprised of fibers molded or encased with a flexible resin.

Unless the context clearly requires otherwise, throughout the description and the claims the words 'comprise', 'comprising', and the like are to be construed in an inclusive sense as opposed to an exclusive or exhaustive sense; that is to say, in the sense of "including, but not limited to".

DETAILED DESCRIPTION OF PREFERRED AND OTHER EMBODIMENTS

Figures 1, 1A:
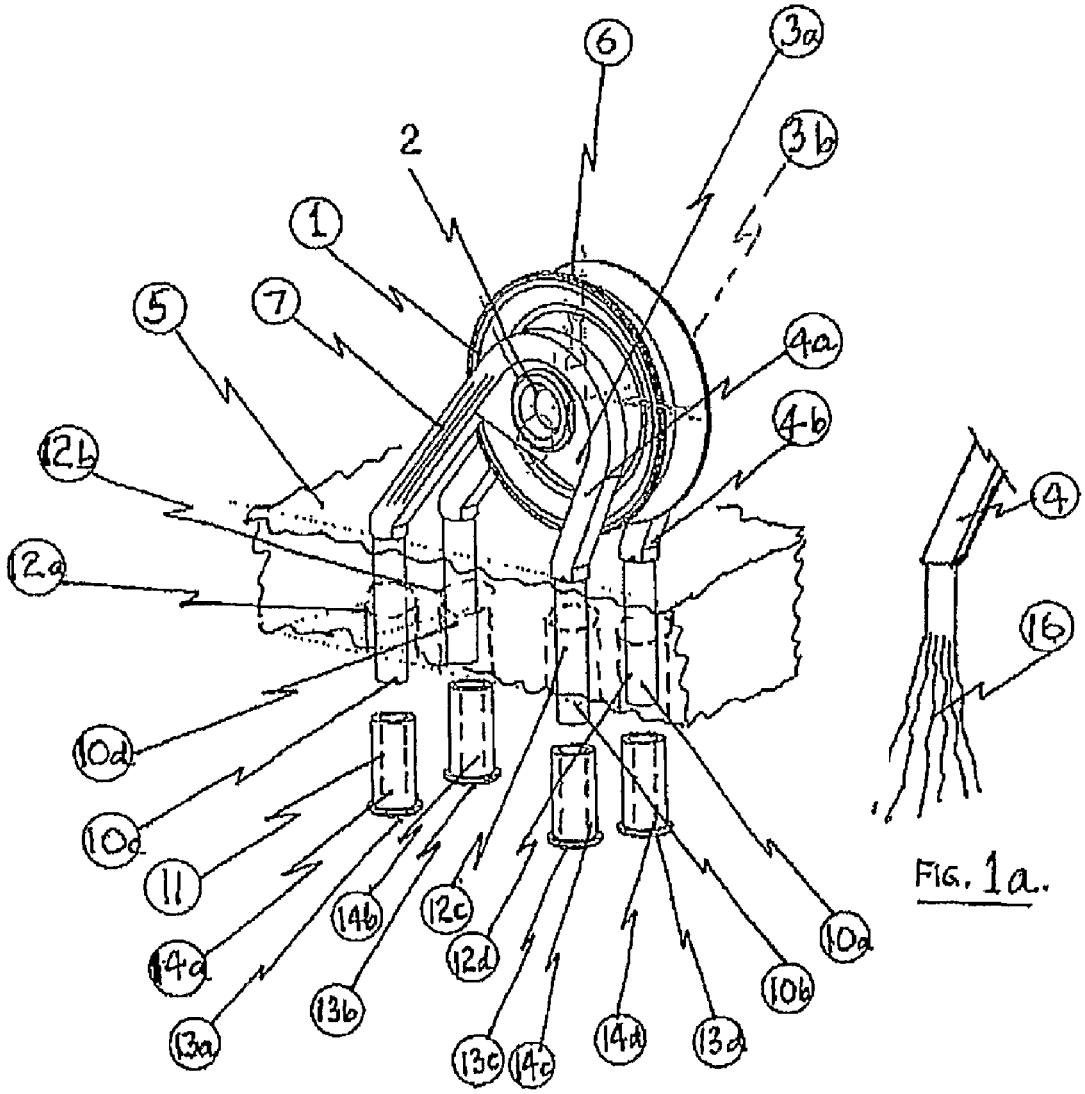
FIG. 1 shows an isometric view of a high load lightweight mast base block assembly with molded high strength fiber bundles employed to take the major tensile loads of the block together with a lightweight non metallic connection system.
FIG. 1*a* shows an alternative leg and termination construction to that of FIG. 1.

FIG. 1 shows a mast base block 1 according to the present invention with sheave 6, shaft 2 and non metallic compression member 3*a* (opposite compression member 3*b* not visible).

High strength molded fiber bundles 4*a* and 4*b* with single elements of fiber bundles partially shown at 7 are molded or glued to compression members 3*a* and 3*b* respectively Fiber bundles 4*a* and 4*b* have rectangular (or circular) cross sections and are aligned to carry primarily tensile loads and extend below sheave 6 and through deck 5. The cross section of the bundles may be other shapes.

The legs of the fiber bundles 4*a* and 4*b* are molded into a circular cross section at deck level and protrude into deck tubes 14*a, b, c*, and *d* in the deck 5 at 10*a, b, c*, and *d*.

Alternatively, the legs can be glued directly into the deck 5 or, as shown, can employ optional molded tubes 14*a, b, c*, and *d* and with beads 13*a, b, c*, and *d*. Optional tubes 14*a, b, c*, and *d* can be used to eliminate the normally used high strength compression plugs.

Tubes 14*a, b, c*, and *d*, have central holes, shown by dotted lines, 11 which slide over legs 10.

Legs 10*a, b, c* and *d* are fitted into the pre drilled deck. Tubes 14*a, b, c*, and *d*, are then fitted from below deck around circular leg portions 10*a, b, c*, and *d* via counter bores 12*a, b, c*, and *d*. The assembly is completed by using glue or resin around legs 10*a, b, c*, and *d* and tubes 14*a, b, c*, and *d*.

This construction provides a rigid high load light weight block assembly without the need for traditional heavy metal construction within the block or for the traditional heavy metal mounting bolts.

FIG. 1*a* shows an alternative leg where solid portion of leg 4 is molded leaving fibers without molding resin at 16. In this variation, legs are applied with resin or glue and fitted to holes in the deck with fibers extending below deck and spread under deck and applied with resin, which upon setting forms a solid anchor.

Figure 1B:
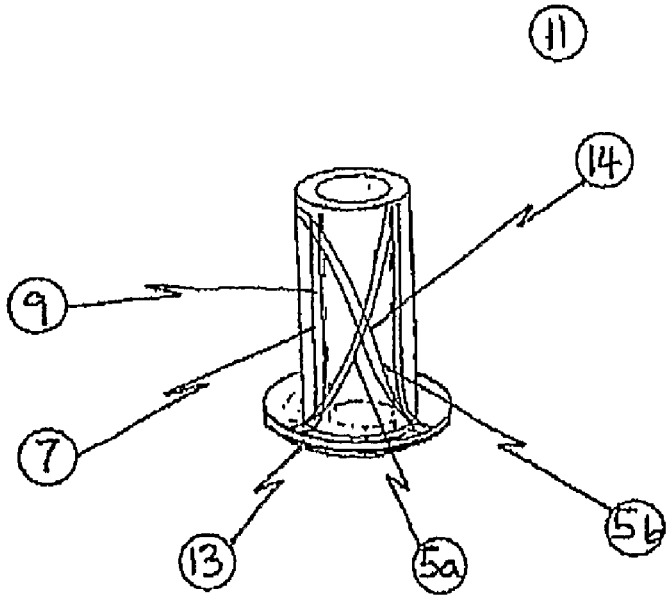
FIG. 1*b* shows an isometric view of the termination tube of FIG. 1.

FIG. 1*b* shows a restraining tube of FIG. 1 constructed using parallel fibers shown at 7 running primarily longitudinally with sufficient fibers to prevent splitting running at right angles to fibers 7 shown at 9.

Alternatively, fibers could also be oriented at an angle shown by 5*a* and 5*b*, with the major orientation of the fibers being longitudinally.

Fibers are compressed at light angles to the hole axis to form head 13.

Figure 2A:
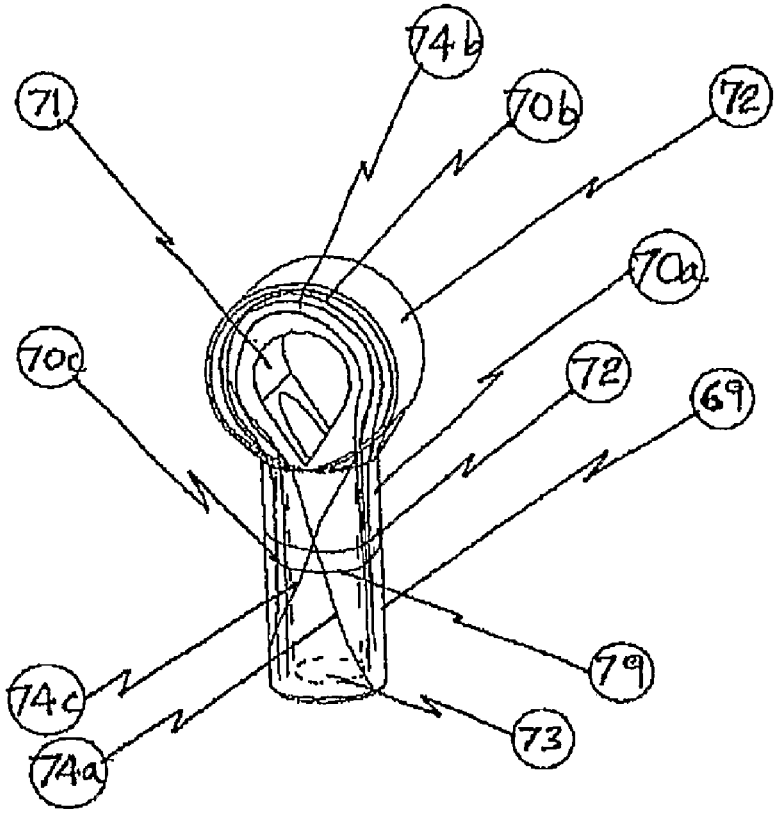
FIG. 2*a* shows an isometric view of alternative termination tube to that of FIG. 1*b*.
Figure 2:
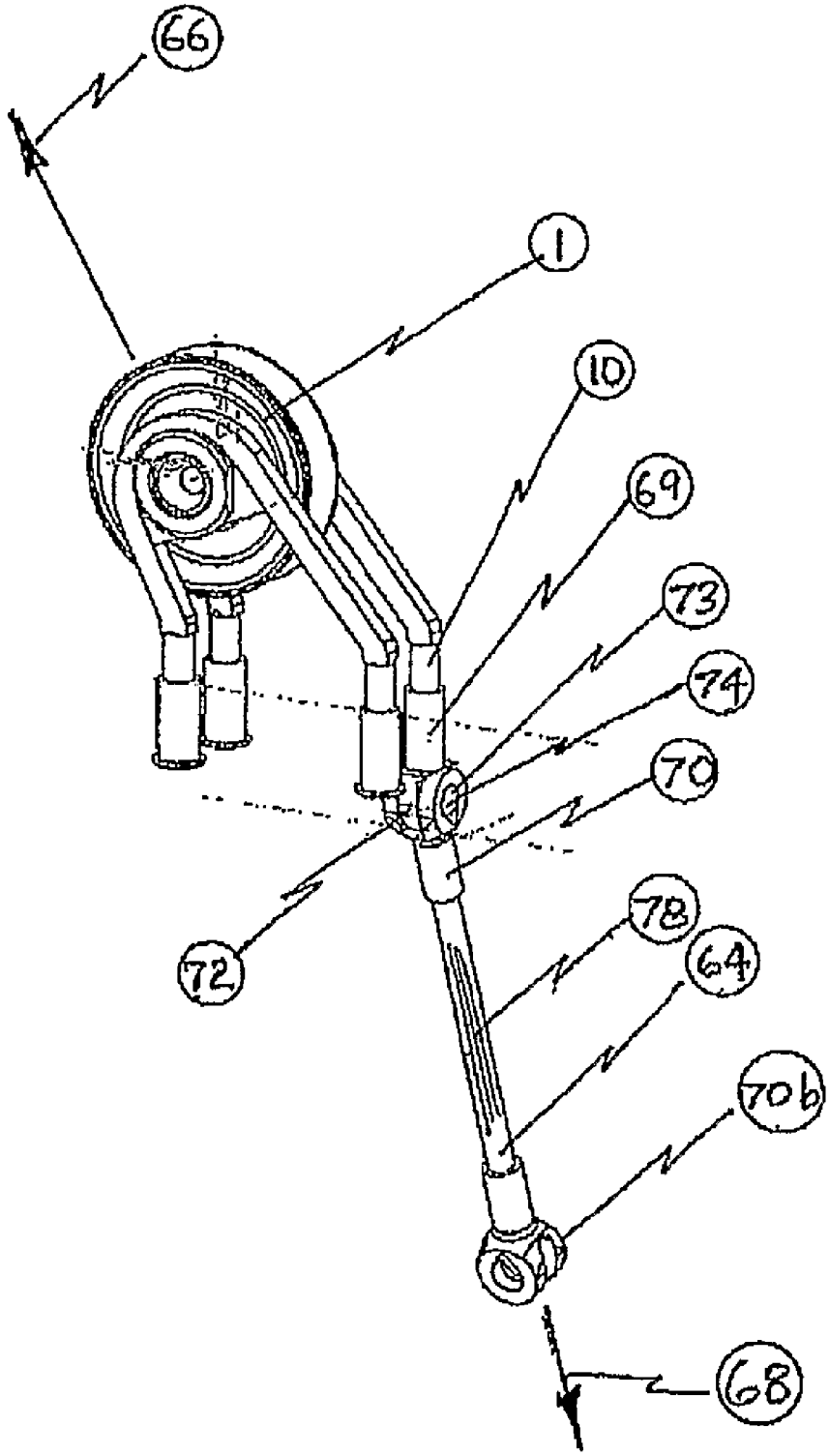
FIG. 2 shows an isometric view of the mast base block of FIG. 1, with the addition of a tensile load support rod.

FIG. 2 shows a below deck tension member 64 for supporting loads 66 of mast base block 1 of FIG. 1. Tension support member 64 is usually terminated at 68 by attachment to mast or floor frames, (not shown).

Tension member 64 is constructed according to the invention, using parallel high strength fiber bundles molded into a rod with glued on end connection pieces 70*a* and 70*b*.

In this embodiment, restraining tube 69 is formed using molded parallel fibers with circular head 72 and cross hole, not visible. Rod end 70*a* is fitted to head 72 of restraining tube 69 and secured by pin 74.

Rod 64 may be rigidly molded using parallel fiber bundles and resin throughout, or by the parallel fiber bundle being molded into heads 70*a* and 70*b* so that no resin is applied to central portion 78, to make an even lighter construction which is flexible and also more easily transported.

FIG. 2*a* shows the construction detail of tube end 69 with central hole 73 and cross hole 71. Molded fibers 70*a*, 70*b* and 70*c* run longitudinally along tube 69 and around head 72 forming cross hole 71 with minor fibers 79 to avoid splitting of tube to form a lightweight high tensile non metallic rigid connection head suitable for gluing to leg 10, or rod 64 of FIG. 2.

In an alternative constriction, fibers 74*a*, 74*b* and 74*c* run primarily longitudinally but are crossed to form a tube which resists splitting.

Figure 3:
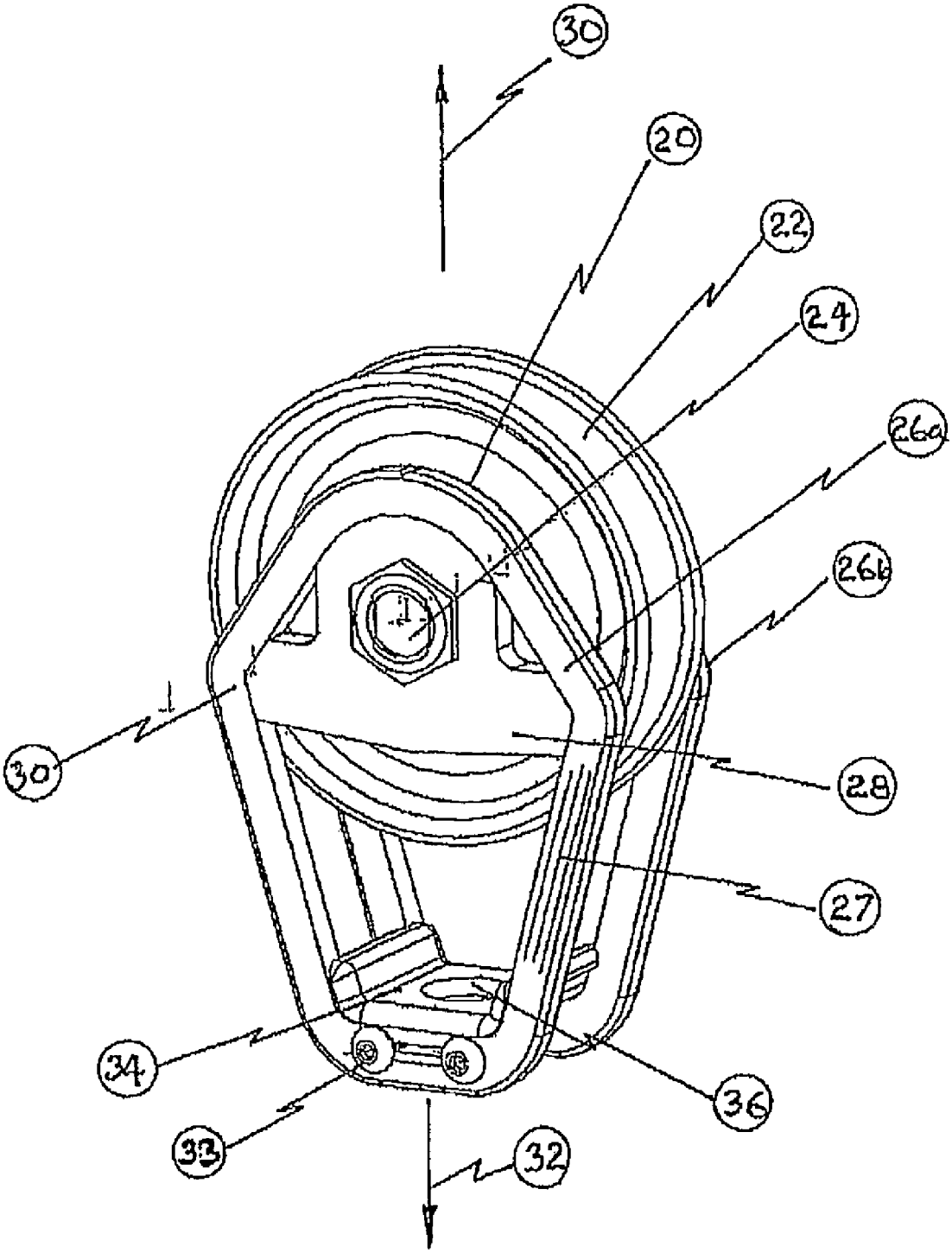
FIG. 3 shows an isometric view of a high load lightweight utility block with molded high strength fiber bundle side plates employed to take the major tensile loads of the block with multiple attachment possibilities.

FIG. 3 shows a block 20 with sheave 22, shaft 24, high strength fiber bundles 26*a*, 26*b*, with partial single fiber elements shown at 27 and compression member 28. Compression member 28 is usually made from a plastic able to withstand high compression. Compression member 28 allows wide spacing of side fiber bundles 26 at 30, to act as a rope guide into sheave 22.

Fiber bundle legs 26*a* and 26*b* are molded continuously so that multiple connection methods such as webbing or swivel (not shown) can be used to connect tensile loads shown at 30 and 32 to be taken primarily by fiber bundle legs 26*a* and 26*b*.

Bolts 33 secure piece 34 which is shaped to allow webbing connection, or swivel connection via hole 36.

Figure 4:
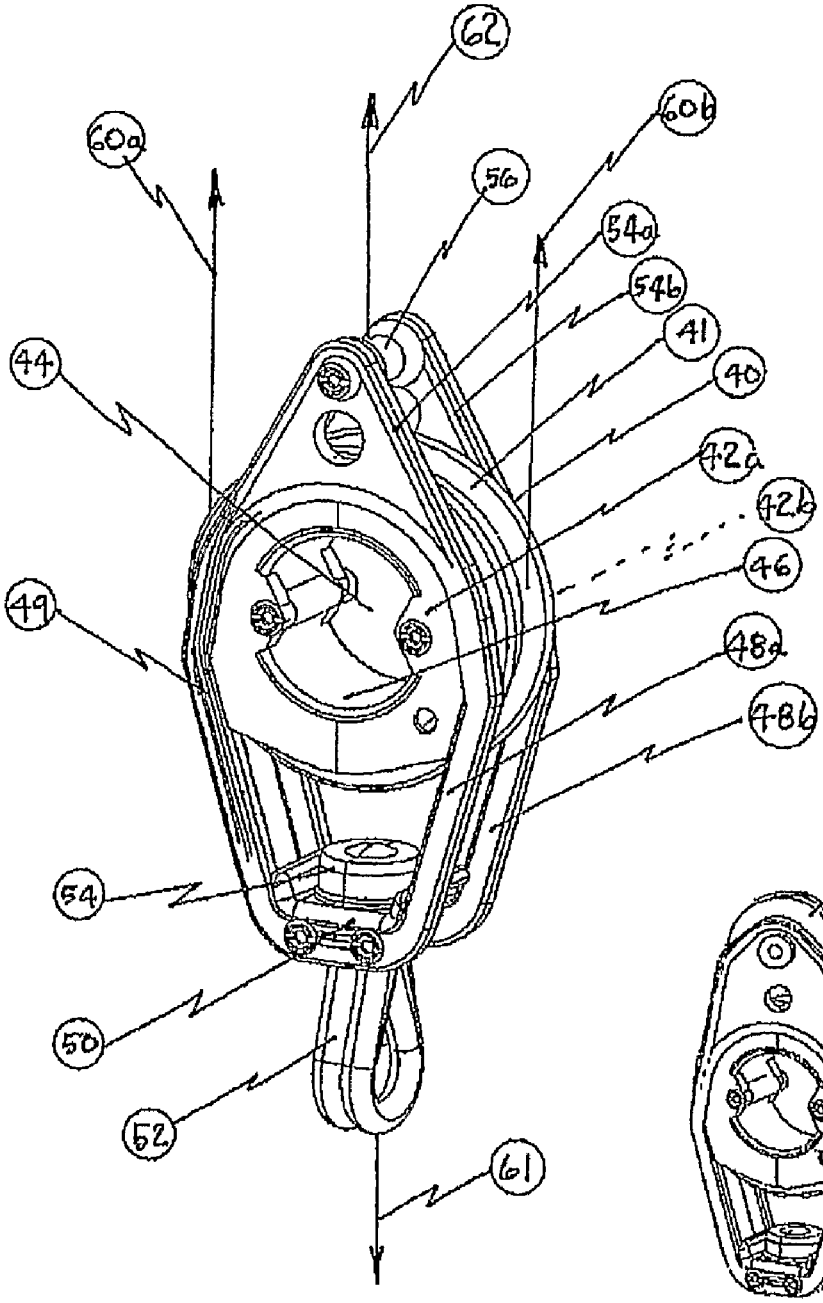
FIG. 4 shows an isometric view of a high load lightweight block with molded high strength fiber bundles employed to take the major tensile loads of the block with the addition of a Becket.

FIG. 4 shows a block 40 with sheave 41 similar to that of FIG. 2 having plastic side plates 42*a* and 42*b* (hidden) with an enlarged central hole 44, and tubular shaft 46 employing roller bearings (not shown).

Molded parallel fiber bundles 48*a* and 48*b* are connected to side plates 42*a* and 42*b*, with partial single fiber elements shown at 49. When loads shown at 60*a* and 60*b* and 62 are applied, side plates transfer loads via shaft 64 and sheave 41 and side fiber bundles 48*a* and 48*b* through end piece 50 and swivel assembly 52, 54 to connection 61.

In this embodiment, side fiber bundles are continuous as shown.

FIG. 4 also shows part of fiber bundle 42*a* and 42*b* extended to wrap around secondary side plates 54*a* and 54*b* which contain a secondary shaft 56 forming a Becket to which load 62 is connected.

End piece 50 rests on lower portion of fiber bundles 42*a* and 42*b* and has a central hole through which soft loop 52 passes.

Soft loop 52 is terminated in body 54 and said swivel assembly allows connection to boat while allowing block 41 to rotate.

Figure 4A:
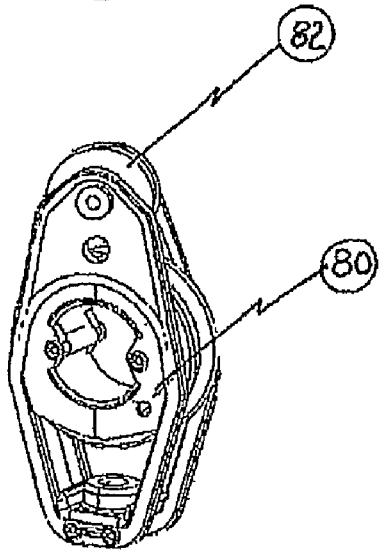
FIG. 4*a* shows an isometric view of a high load lightweight block with molded high strength fiber bundles employed to take the major tensile loads of the block with the addition of a second sheave to form a spriddle block together with a swivel connection employing a soft loop.

FIG. 4*a* shows a block 80 similar to block 40 of FIG. 4 but with second sheave 82 in place of the Becket 56 of FIG. 4.

Figure 5:
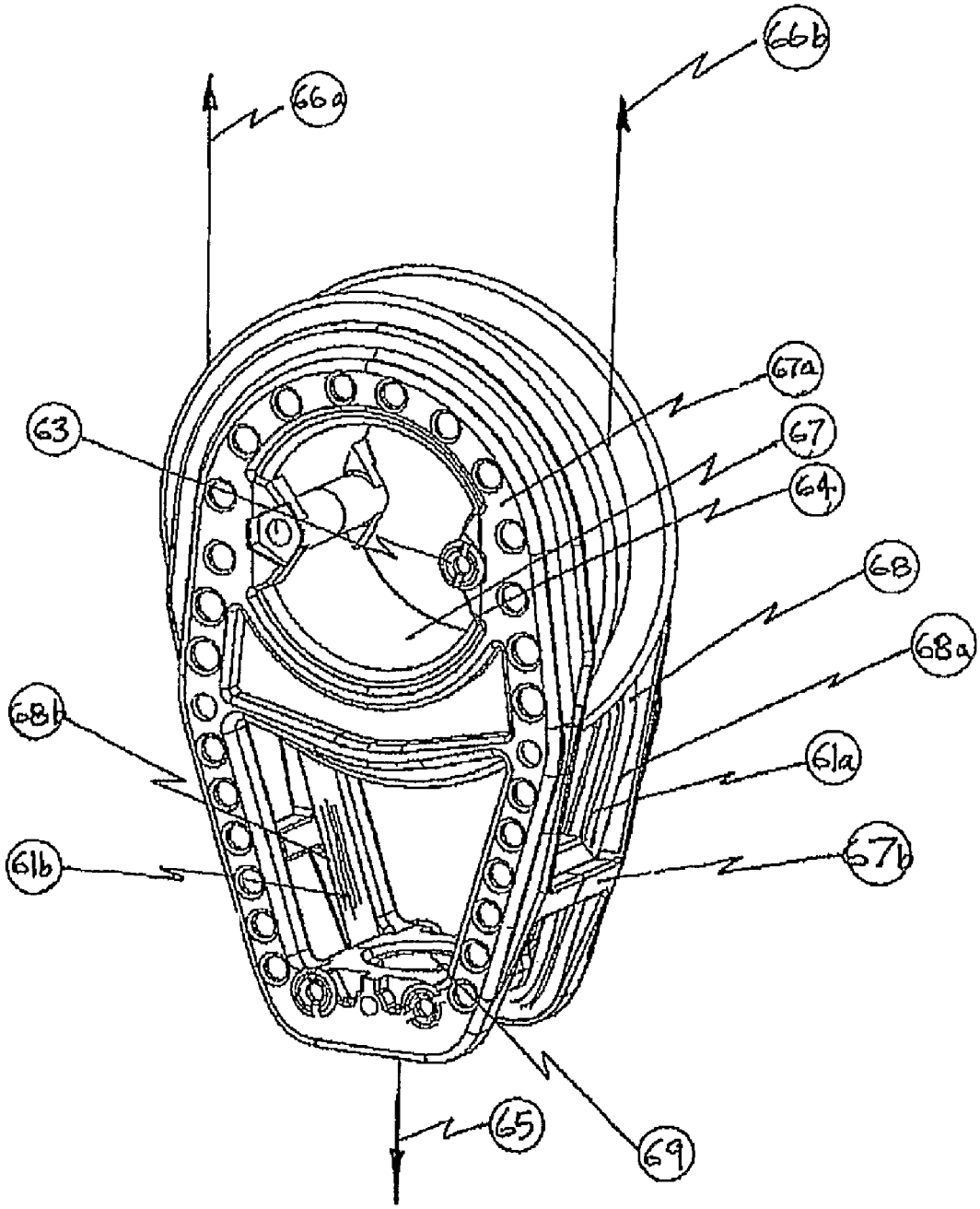
FIG. 5 shows an isometric view of a high load lightweight utility block with molded high strength fiber bundles employed to take the major tensile loads of the block, encased within molded low strength side plates.

FIG. 5 shows a block 64 with shaft 67 and molded side plates 67*a* and 67*b* with an assembly bolt head shown at 63.

The major tensile loads shown by arrows 66*a*, 66*b* on one side and 65 on the opposite side, are taken, according to the invention, by largely continuously wound fiber bundles which run around the periphery of block 64 shown visibly by 68*a* and 68*b* with single fiber elements within molded bundles 68 shown at 61*a* and 61*b* and encased within side plates 67*a* and 67*b*. Lower portion 69 of block 64 is configured to include alternative attachments such as swivel or webbing.

Figure 6:
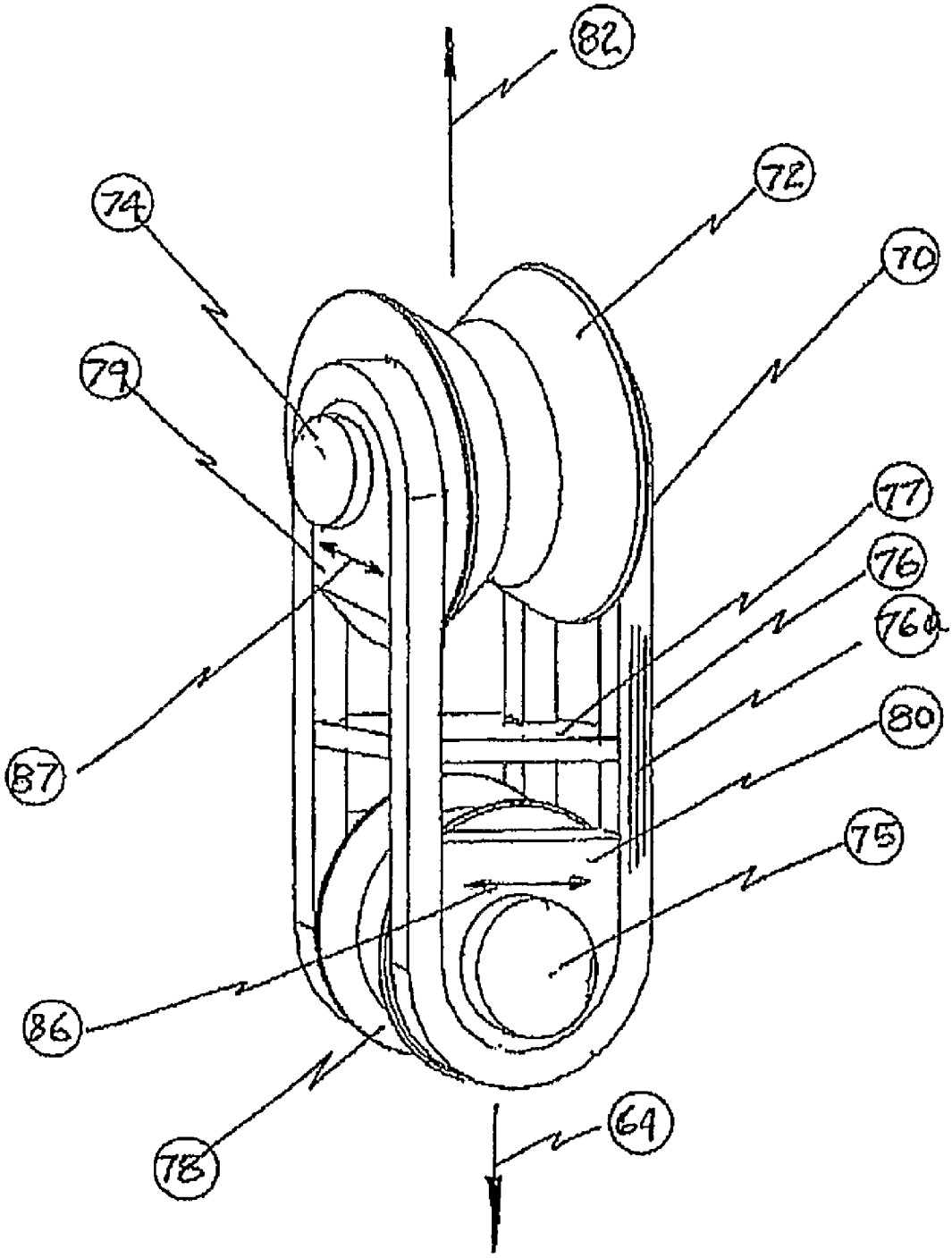
FIG. 6 shows an isometric view of a high load lightweight utility block with molded high strength fiber bundles employed to take the major tensile loads of the block, in the form of a two to one block.

FIG. 6 shows an alternative two to one block arrangement 70 comprising two sheaves 72 and 78 with shaft heads 74 and 75 respectively.

According to the invention, rigid wound and molded high strength fiber bundle 76 with single fiber elements within molded bundles 76 shown partially at 76*a* run around block 70 to take the majority of the loads shown at 82 and 84. Side plate members 79 and 80 locate shafts 74 and 75 and absorb compression loads shown by allows at 86 and 87 while an optional separation plate 77 divides the block, to form an extremely lightweight compact rigid two to one block.

Figure 7:
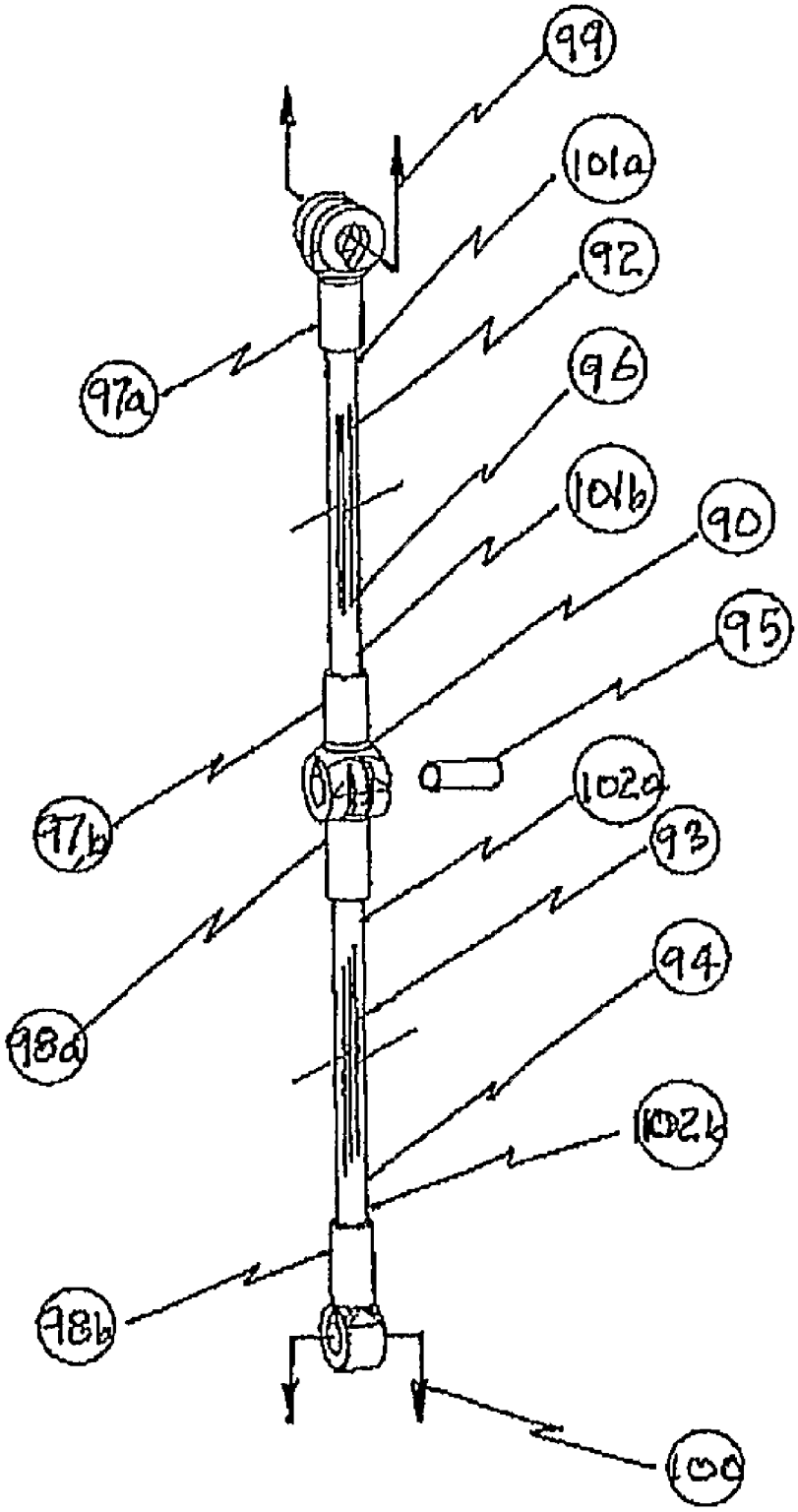
FIG. 7 shows an isometric view of a lightweight shroud or stay with fiber bundle and end assemblies used for the support of high tensile loads, without the use of metal.

FIG. 7 shows a tensile connection device 90 which can be applied to stays or shrouds, comprising high strength molded fiber bundles shown at 92, 93, 94 and 96, glued to ends 97*a* and 97*b* and 98*a* and 98*b*. Stay 90 is designed to take tensile loads applied through shafts through holes 99 and 100 and central shaft 95. Ends 97 and 98 being similar in construction to end 72 of FIG. 2*a*.

Tensile members shown at 92, 93, 94 and 96 can be made up of rigid molded fiber bundles as described herein or may be loose or flexibly molded at these points 92, 96, 93 and 94 and then glued into ends 97*a* and 97*b* and 98*a* and 98*b* shown by 101*a* and 101*b* and 102*a* and 102*b* respectively.

It should be noted that the concepts disclosed are not meant to be complete or define a particular model or limit the concepts or application in any way.

From the foregoing it should be readily evident that that there has been provided an improved lightweight high load block assembly and connection method.

The claims defining the invention are as follows:

1. A rigid block having:

at least one sheave mounted between opposed side plates for rotation about at least one corresponding axis, at least one of the side plates comprised of a portion of at least one elongate substantially unidirectional and substantially continuous fiber bundle, the portion passing around the corresponding axis and being molded in a rigid resin with lengths of the at least one fiber bundle extending from either end of the portion, whereby a tension load applied to said at least one sheave is transferred via the at least one portion to the lengths of the at least one fiber bundle extending from either end of the portion.

2. The block of claim 1 wherein at least two side plates are comprised of at least one fiber bundle.

3. The block of claim 1 wherein the or each fiber bundle is formed of a plurality of fiber strands.

4. The block of claim 1 wherein at least two side plates are comprised of the same at least one fiber bundle.

5. The block of claim 1 wherein the or each fiber bundle is formed of a single fiber strand.

6. The block of claim 1 wherein the or each at least one fiber bundle forms at least one continuous loop.

7. The block of claim 1 wherein the at least one fiber bundle has ends.

8. The block of claim 1 including a first sheave mounted between a first pair of side plates, for rotation about a first axis, and a second sheave mounted between a second pair of side plates, for rotation about a second axis, said second axis spaced from the first axis, wherein at least one of the first and at least one of the second side plates is comprised of the same fiber bundle.

9. The block of claim 8 wherein at least one first and at least one second side plates is comprised of the same fiber bundle that forms a continuous loop.

10. The block of claim 8 wherein both first and both second side plates are comprised of the same fiber bundle that forms a continuous loop.

11. The block of claim 1 wherein the at least one fiber bundle has ends extending from the central portion adapted to be secured in or to the structure of a boat.

12. The combination of a boat and the block of claim 11.

13. An elongate tension member comprising:

a rod comprising at least one first bundle of unidirectional and substantially continuous fibers molded in a rigid resin at least one end to form the rod, and an end terminating eye piece having an eye therein, said eye piece connected to the rod, said the eye piece comprising at least one second bundle of unidirectional and substantially continuous fibers molded in a rigid resin about the eye, said eye piece connected to the end of the rod, whereby tensile loads applied to the tension member are transferred via the rod end and the eye piece.

14. The tension member of claim 13 wherein both ends of the at least one first bundle of unidirectional and substantially continuous fibers are molded in a rigid resin to form a rod at each end thereof and eye pieces are connected to the ends of the at least one bundle of fibers.

15. The tension member of claim 13 wherein the at least one end is received in a corresponding recesses in the eye piece.

16. The tension member of claim 13 wherein at least an intermediate portion of the at least one bundle of fibers is flexible.

17. The tension member of claim 16 wherein the intermediate portion is substantially comprised of fibers without resin.

18. The tension member of claim 16 wherein the intermediate portion is comprised of fibers molded or encased with a flexible resin.

* * * * *